US010305159B2

(12) United States Patent
Sikora et al.

(10) Patent No.: US 10,305,159 B2
(45) Date of Patent: May 28, 2019

(54) APOLLONIAN-LOADED SPLIT-RING RESONATOR AND METHOD FOR DESIGNING THE SAME

(71) Applicant: THE UNITED STATES OF AMERICA AS REPRESENTED BY THE SECRETARY OF THE AIR FORCE, Washington, DC (US)

(72) Inventors: Paul A. Sikora, Holland Patent, NY (US); Mark A. Southcott, Rome, NY (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 53 days.

(21) Appl. No.: 15/682,648

(22) Filed: Aug. 22, 2017

(65) Prior Publication Data

US 2019/0067786 A1 Feb. 28, 2019

(51) Int. Cl.
*H01P 7/04* (2006.01)

(52) U.S. Cl.
CPC ..... *H01P 7/04* (2013.01)

(58) Field of Classification Search
CPC ..... H01P 7/04; H01P 1/2013; H01Q 7/00; H01Q 9/265
USPC ..... 333/219
See application file for complete search history.

(56) References Cited

U.S. PATENT DOCUMENTS

2010/0134216 A1* 6/2010 Naji ..... H01P 7/08 333/235
2011/0095851 A1* 4/2011 Wyland ..... H01L 23/66 333/219

* cited by examiner

*Primary Examiner* — Robert J Pascal
*Assistant Examiner* — Kimberly E Glenn
(74) *Attorney, Agent, or Firm* — Joseph A. Mancini

(57) ABSTRACT

The invention provides an apparatus comprising a wide bandwidth resonating structure based on a primary split ring resonator having a plurality of additional split ring resonators bounded by the primary split ring resonator. The invention provides a method for optimizing the placement and size of the additional split ring resonators to achieve the desired bandwidth for the overall resonator structure.

8 Claims, 11 Drawing Sheets

APOLLONIAN-LOADED SPLIT-RING RESONATOR AND METHOD FOR DESIGNING THE SAME

STATEMENT OF GOVERNMENT INTEREST

The invention described herein may be manufactured and used by or for the Government for governmental purposes without the payment of any royalty thereon.

BACKGROUND OF THE INVENTION

The Split Ring Resonator (SRR) is one of the most common unit cell configurations found in metamaterials. One of the main problems being faced with traditional SRR geometries is a lack of bandwidth. Additionally, an area of great interest would be attaining in some level of reconfigurability with a metamaterial surface.

Referring to FIG. 1*a* and its circuit equivalent in FIG. 1*b*, the traditional SRR configuration is a planar ring 10 with some number of gaps 20 in it. The E-field is most focused in these gaps. Typically, frequency tuning is achieved through either the addition of stubs, loading some lumped elements in the gap, or loading the outermost ring 10 with a number of concentric inner rings 30, 40, 50. Each of these has distinct advantages and drawbacks.

The addition of a planar stub (not depicted) can effectively create a planar-profile load on the split ring resonator, but this type of load is static and cannot be tuned. Typically, planar stubs are done on the exterior of the cell and cause an increase in the overall cell area. The alternative of adding lumped elements (not depicted) into the gap may provide more variation and ability to tune the SRR, especially with the use of varactors. These, however, can only be tuned to maximize response at one frequency at a given time. Finally, the addition of the interior concentric rings 30, 40, 50 provides a static load, but its area is necessarily bounded by the outermost ring. Unfortunately, added rings beyond the 3rd, 4th, or 5th, depending on the fill ratio, tend to have a dramatically reduced effect.

OBJECTS AND SUMMARY OF THE INVENTION

It is therefore an object of the present invention to provide electronic resonator structures having greater bandwidth and method for designing the same.

It is a further object of the present invention to specifically provide split ring resonators and a method for designing the same.

It is yet a further object of the present invention to provide a split ring resonator being loaded by a plurality of additional inner split ring resonators and method for designing the same.

It is yet still another object of the present invention to provide split ring resonator being loaded by a maximum number of additional inner split ring resonators and method for designing the same.

Briefly stated, the present invention provides an apparatus comprising a wide bandwidth resonating structure based on a primary split ring resonator having a plurality of additional split ring resonators hounded by the primary split ring resonator. The invention provides a method for optimizing the placement and size of the additional split ring resonators to achieve the desired bandwidth for the overall resonator structure.

In a preferred embodiment of the present invention, a resonator comprises a primary conductor having a first end and a second end and being substantially annular shaped, disposed on a substrate and a plurality of secondary conductors each having a first end and a second end and being substantially annular shaped, disposed on the same substrate and being bounded by the primary conductor, and a plurality of tertiary conductors each having a first end and a second end and being substantially annular in shape, disposed on the same substrate and bounded by the primary conductor, where the tertiary conductors are determined in dimension according to an iterative computation of a particular mathematical formula.

In a preferred embodiment of the present invention, a method for designing a substantially planar resonator, comprises the steps of selecting a predetermined radius and cross-sectional width of a annularly shaped outer conductor; selecting a predetermined radius, cross-sectional width, and location of a first pair of annularly shaped inner conductors such that they are bounded by the annularly shaped outer conductor and substantially tangent to each other and to the annularly shaped outer conductor; and iteratively generating, according to a predetermined function, successive annularly shaped inner conductors, each being bounded by the annularly shaped outer conductor and each being substantially tangent to at least two preexisting annularly shaped conductors.

DETAILED DESCRIPTION OF THE PREFERRED EMBODIMENT

Figure 1A:
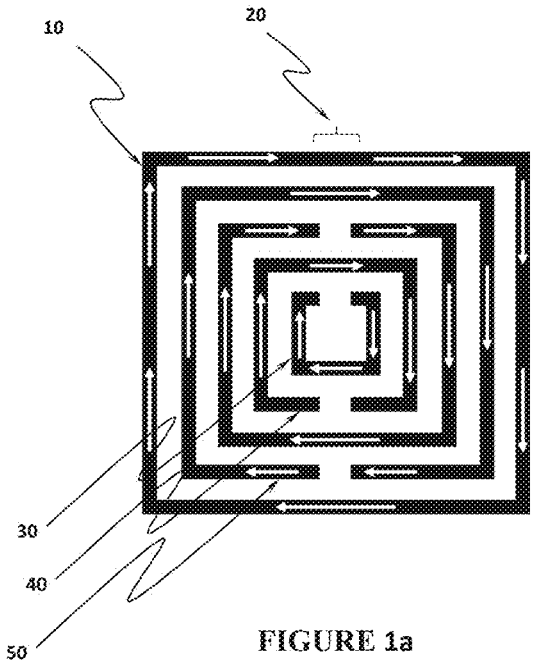
FIG. 1*a* is an example of a Multiple Split Ring Resonator with N=4 split rings.
Figure 1B:
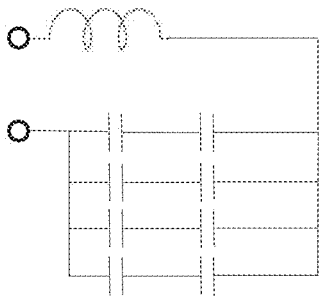
FIG. 1*b* is a quasi-static equivalent circuit of a Multiple Split Ring Resonator with N=4 split rings.
Figure 2:
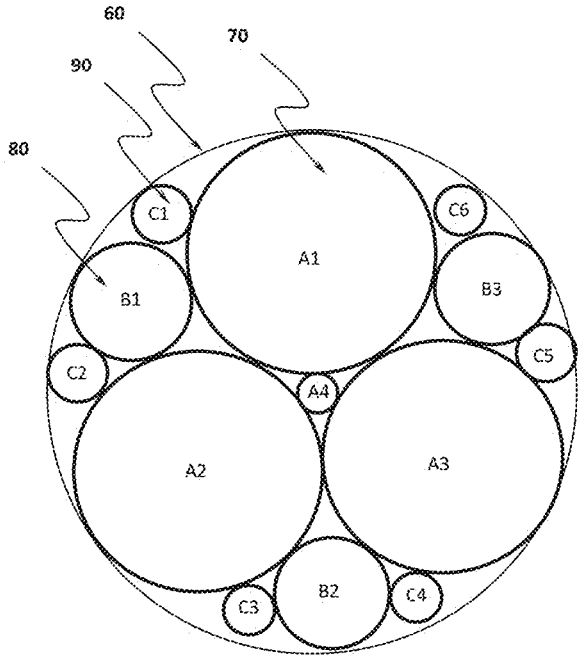
FIG. 2 is an example of an Apollonian Gasket.

Referring to FIG. 2, the present invention provides different manner of loading the interior of the split ring resonator with additional split ring resonators (see FIG. 1*a*), but without being bound to a concentric geometry. The design methodology of the alternative split ring resonator geometry of the present invention is based on the Apollonian Gasket computation.

Still referring to FIG. 2, The Apollonian Gasket concept is characterized by a fractal geometry that is similar to a circle packing problem. The difference is that the circles are not of a unit size, but rather vary in their radii. The math behind this is based in Descartes's Theorem, $$d = a + b + c \pm 2^2\sqrt{ab + bc + ca},$$

which allows for the calculation of the curvatures of the outer circle 60 tangent to the original three inner circles A1 70, B1 80 and C1 90. Descartes's Theorem also allows for the calculation of the center point of the circle, by using the same theorem but instead of inserting curvatures, the center locations are inserted as complex variables, in the format of x+yi. From an initial three circles of any size, an infinite number of additional circles (i.e., A2, A3, A4; B2, B3; C2, C3, C4, C5, C6) can be generated inside of a given area A5 60, as depicted in FIG. 2.

Figure 3:
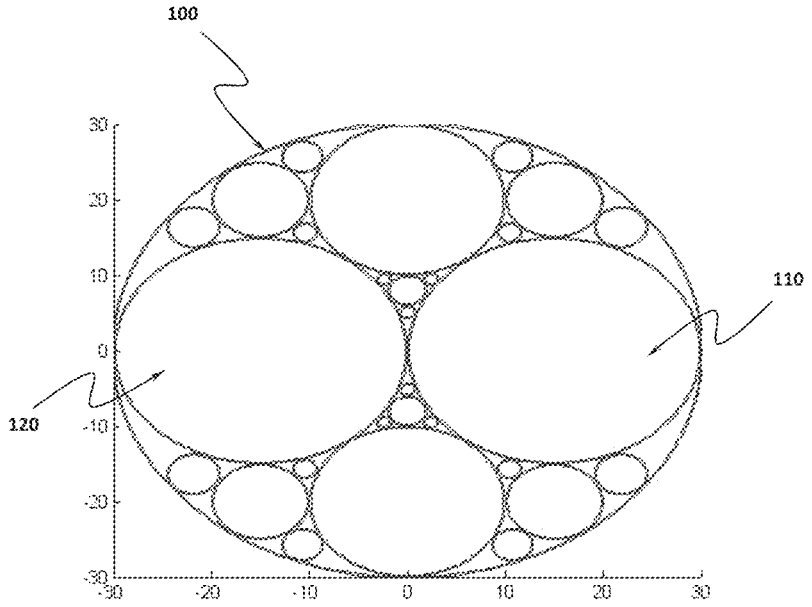
FIG. 3 is an example of a possible Apollonian-Loaded Split King Gasket resonator layout.
Figure 4A:
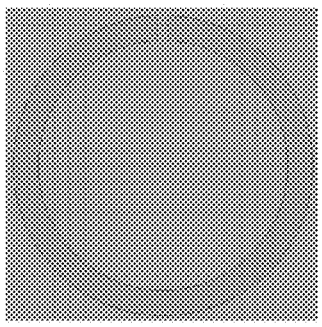
FIG. 4*a* is a single primary split ring resonator with its reflected power versus frequency depicted in FIG. 4*b*.
Figure 4B:
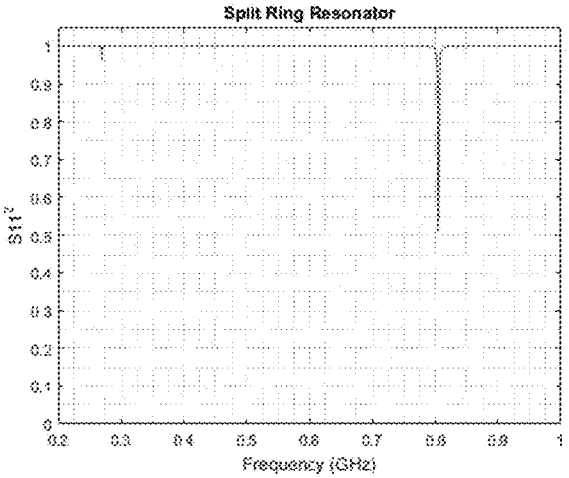

Referring to FIG. 3, the present invention as disclosed utilizes a single Apollonian Gasket structure as the basis for designing a layout for a resonator structure. One embodiment disclosed is a structure (or constructor) comprising an outer circular shape 100 (or rather, a SRR) with 2 inner circular shapes 110, 120 (either as solid patches or as split rings themselves) whose diameter is equal to the radius of the outer circle. This structure is special as it is the to only resonator structure which achieves complete symmetry while still maintaining integer curvatures. This will make scaling the invention much easier to perform.

One goal of the present invention is to create a reasonably-sized structure for lower high frequency (HF) band use. There is some renewed interest in HF bands for some military communication systems. The challenge lies in the size, weight and power (SWAP) footprint of the antenna. There is an interest in reconfigurability as well as highly directional and/or multi-beam links.

A design consideration in one embodiment of the present invention is the effectiveness of loading the outer SRR with tangent inner SRRs or patches, with just the 3 structures. The effectiveness can be determined by comparison to a standard circular SRR of similar trace width. Next, the radii of the inner circles may be reduced by a nominal amount to create a small gap between the outer structure and the inner structures, as well as between the inner structures, to induce a capacitive loading similar to the way a concentric SRR operates. The effectiveness of this design parameter can be determined by comparison to a single SRR and a concentric SRR of similar trace widths and gap distances.

In the present invention each iteration of gasket construction adds $2*3^{n-1}$ circles, where n is the iteration number, starting with 1 for the iteration following the constructor. After the 3 iterations, there will be a total of 29 circular structures, and would look something like that shown in FIG. 3. The effectiveness of this design parameter can be determined for each of these iterations, both for patches and for internal SRRs can be compared and contrasted with each other, as well as with a single SRR, and a concentric SRR whose number of inner rings is equivalent to the number of iterations of the SRR layout.

Additional design parameters for the present invention include examining the effects of orientation of the inner structure on the outer SRR, comparing each of the iterations at 0° to and 90° with respect to the outer ring resonator to see how the orientation of the inner structure compared to the gap width. Additionally, the effects of altering the orientation of the gaps of the interior SRR structures, in terms of their gaps facing towards the edge of the SRR or inwards towards the center of the structure can be determined.

Additional parameters include taking the constructor and the first iteration circles (the is biggest 4), and turning them into outer circles of an additional 1 iteration loading gasket (both patch and SRR) and comparing the results obtained to the original constructor and first iteration. Yet another design parameter includes examining the effects of introducing variable biasing components, namely varactors, in the splits or gaps of the internal rings and external ring of the gasket and/or between both the internal and external rings. This would increase the parameters for tenability by orders of magnitude, which would hopefully culminate in a widely tunable structure.

EXAMPLES

For the purpose of the following examples the conductors comprising the resonator structure are denoted as "circles", being arranged and further denoted as "outer" circles, "inner" circles, "left" or "right" circles and finally circle designations C1 through C10. Also, circle center point locations are denoted as (x,y) and curvature is normalized as the inverse of the circle radius.

Figure 5A:
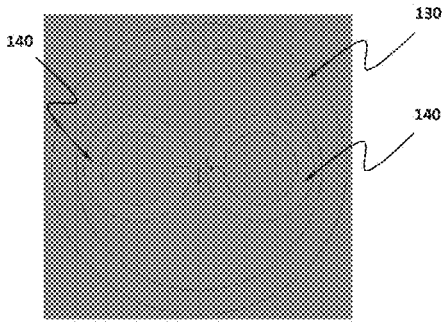
FIG. 5*a* is a single primary split ring resonator with two secondary split ring resonators having 5 degree gaps facing inward with its reflected power versus frequency depicted in FIG. 5*b*.
Figure 5B:
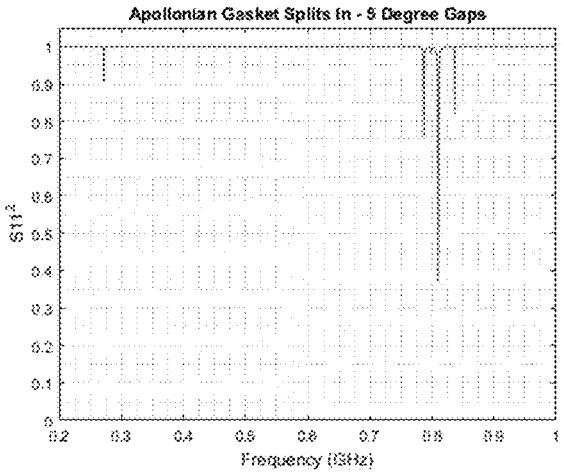
Figure 6A:
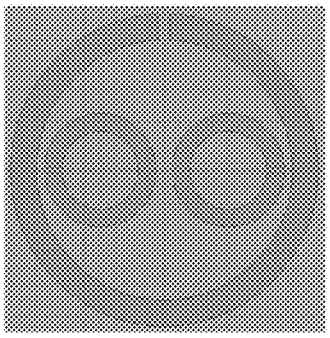
FIG. 6*a* is a single primary split ring resonator with two secondary split ring resonators having 5 degree gaps facing outward with its reflected power versus frequency depicted in FIG. 6*b*.
Figure 6B:
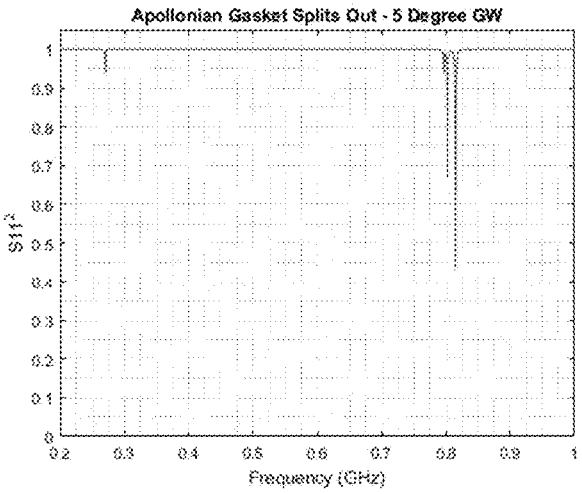
Figure 7A:
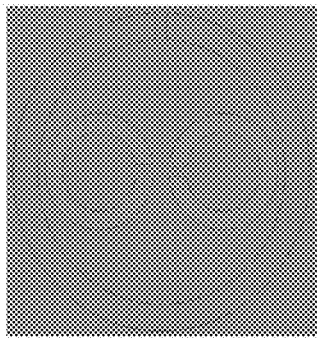
FIG. 7*a* is a single primary split ring resonator with two secondary split ring resonators having 15 degree and 10 degree gaps facing inward with its reflected power versus frequency depicted in FIG. 7*b*.
Figure 7B:
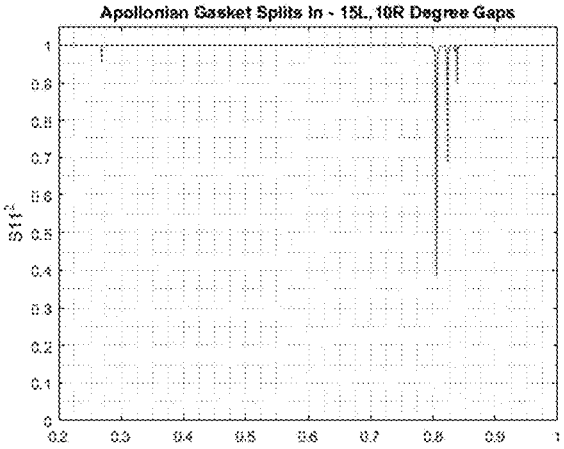
Figure 8A:
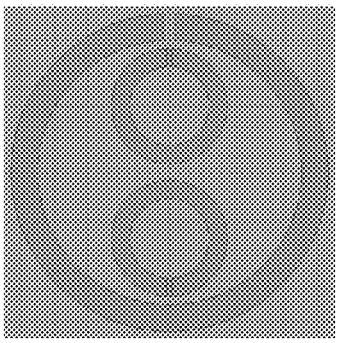
FIG. 8*a* is a single primary split ring resonator with two secondary split ring resonators having 5 degree gaps facing outward with its reflected power versus frequency depicted in FIG. 8*b*.
Figure 8B:
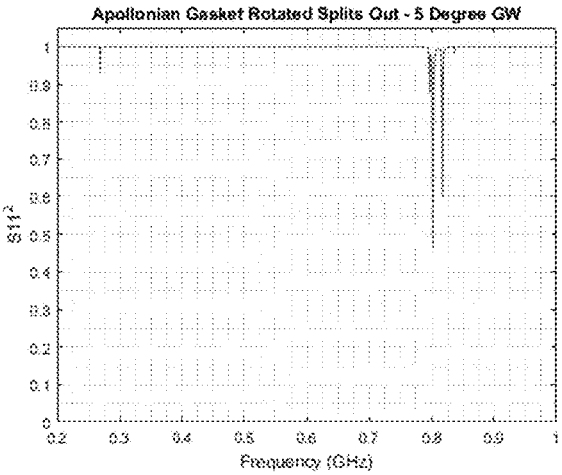

With respect to the resonator depicted in FIG. 5*a*, the "circles" which comprise it are denoted as follows:

| Circle | Normalized Curvature (1/radius) | Center Point |
|---|---|---|
| Outer | −1 | (0, 0) |
| Inner Left | 2 | (−150 mm, 0) |
| Inner Right | 2 | (150 mm, 0) |

Figure 9A:
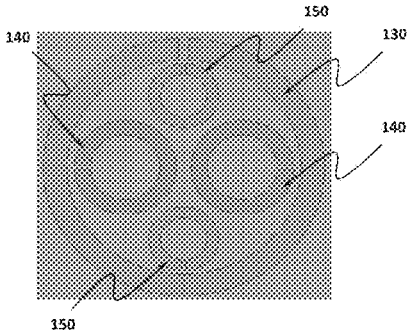
FIG. 9*a* is a single primary split ring resonator with four secondary split ring resonators having 5 degree gaps facing outward with its reflected power versus frequency depicted in FIG. 9*b*.
Figure 9B:
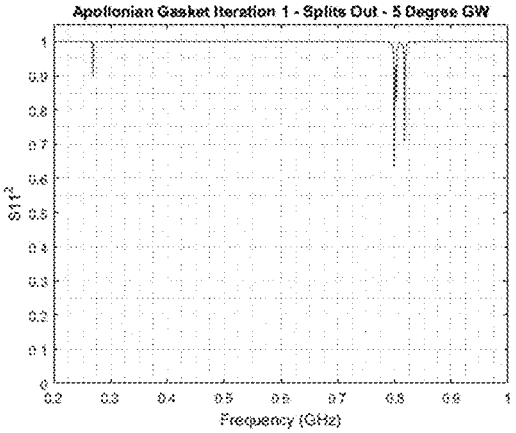
Figure 10A:
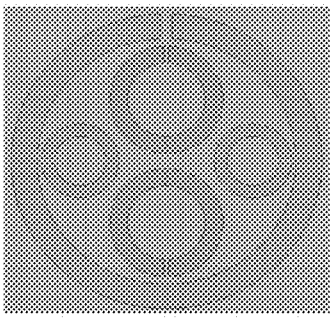
FIG. 10*a* is a single primary split ring resonator with four secondary split ring resonators having 5 degree gaps facing outward with its reflected power versus frequency depicted in FIG. 10*b*.
Figure 10B:
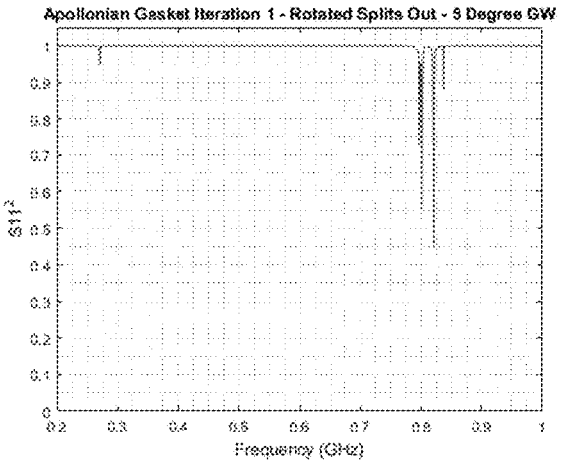
Figure 11A:
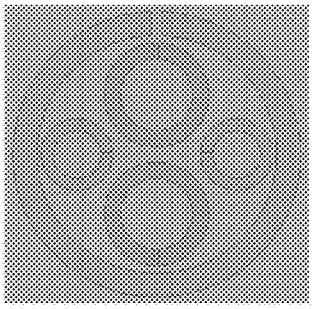
FIG. 11*a* is a single primary split ring resonator with four secondary split ring resonators having 5 degree gaps, 2 facing outward and 2 facing inward with its reflected power versus frequency depicted in FIG. 11*b*.
Figure 11B:
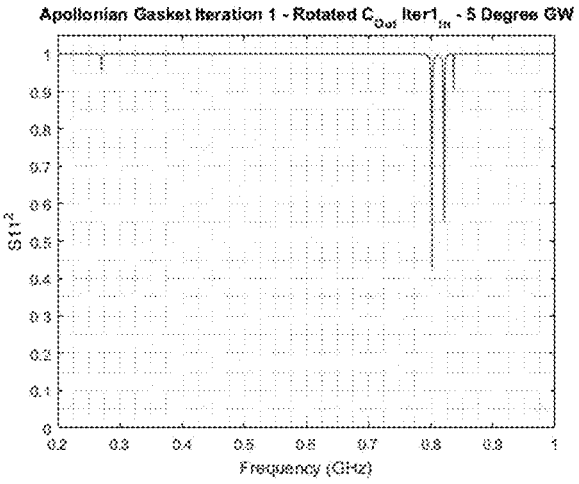

Outer Circle (C1) 130 by definition, has a normalized curvature of −1. Outer Circle (C1) 130 is deemed a "primary" conductor in the resonator design method because it is a predetermined structure not being produced by any iteration of the design methodology and because it bounds all subsequent conductors within its circumference. It is also deemed a "reference" conductor because it will be one of the three conductors necessary for the first iteration of the generation of a plurality of conductors in the resonator design method. But because it is a resonator element it requires width, which gives it an actual inner radius of 300 mm. Inner two circles 140, 140 (C2 and C3) have curvature of 2 (in image, less some separation distance, which was arbitrarily defined but can be ignored for the purpose of the process as it's an after effect) and have radii of 150 mm, or a normalized radius/2. Inner two circles 140, 140 (C2 and C3) are deemed "secondary" conductors because they are each a predetermined structure having a circumference and are not produced by any iteration of the design methodology. So to generate the new circles 150 depicted in FIG. 9*a*, the following steps are applied as a first iteration of the iterative process to produce a plurality of non-overlapping resonator structures bounded by the Outer Circle (C1). It is important to note that the iterative process that computes Descarte's Theorem will produce new resonator circles (d) of circumferences that are tangent to all three of the reference resonator circles (a, b, c). However, higher order successive resonator circles may be nearly tangent to each other while not necessarily being tangent to the reference circles. At any given iteration, reference circles a, b, c may be selected from any resonator circles existing at that time. Note that in the first iteration, the first of the required three reference circles is reference circle a is the to primary resonator circle or Outer Circle (C1) 130 and secondary resonator circles, the inner two circles 140, 140 (C2 and C3) are selected as reference circles b and c. Selecting combinations of any three existing resonator circles as reference circles a, b, c in successive iterations will have the tendency to completely populate the interior of the primary resonator with successively smaller diameter tertiary resonators into "residual" space not currently is occupied by a resonator, with the limitation being the desired frequency response of the composite resonator structure and of course the limitation of the fabrication process from which the composite resonator structure will be produced.

Iteration 1:

Step 1: Apply Descartes' Theorem to the normalized curvatures from the previous iteration (as in FIG. 5*a*) to determine the radii of the new circles 150.

$$d = a + b + c \pm 2^2\sqrt{ab + bc + ca}$$

$$d = -1 + 2 + 2 \pm 2^2\sqrt{(-1)2 + 2*2 + 2*-1}$$

$$d = 3 \pm 2^2\sqrt{0} = 3$$

Therefore, the normalized curvature will be 3. So: 300 mm*⅓ yields radii for the adjacent circles of 100 mm.

Step 2: Apply a modified version of Descartes' theorem that describes the center points to determine the center point of the new circles 150, using the curvatures multiplied by the center points in the form X±Yi.

$$d(X_4 + Y_4 i) = a(X_1 + Y_1 i) + b(X_3 + Y_3 i) + c(X_3 + Y_3 i) \pm 2^2\sqrt{a(X_1 + Y_1 i)b(X_2 + Y_2 i) + b(X_2 + Y_2 i)c(X_3 + Y_3 i) + c(X_3 + Y_3 i)a(X_1 + Y_1 i)}$$

$$(X_4 + Y_4 i) = \frac{-1(0 + 0i) + 2(-150 + 0i) + 2(150 + 0i) \pm 2^2\sqrt{2(150 + 0i)*2(-150 + 0i)}}{3}$$

$$(X_4 + Y_4 i) = \frac{0 \pm 4^2\sqrt{-22500}}{3} = \frac{0 \pm 4(150i)}{3}$$

$$d = 0 \pm 200i$$

So, the new circles 150 (C4 and C5) will be centered at (0, ±200) with radii of 100 mm (the outer radii again reduced in the image by a nominal amount to prevent them from being completely tangent).

Iteration 2:

The process can now repeat with the combinations of (C1, C2 or C3, and C4 or C5) and (C2, C3, and C4 or C5) which will yield the locations of the new circles. Going through the process again with C1, C2, and C4

Step 1: Apply Descartes' Theorem to the normalized curvatures to determine the radii of the new circles (no figure depicted).

$$d = a + b + c \pm 2^2\sqrt{ab + bc + ca}$$

$$d = -1 + 2 + 3 \pm 2^2\sqrt{(-1)2 + 2*3 + 3*-1}$$

$$d = 4 \pm 2^2\sqrt{1} = 6 \text{ and } 2$$

Since the curvature 2 circle already exists (C3), the 2 is discarded. The curvature of one of the new sets of circles will be 6, or a radius equal to 50 mm.

Step 2: Apply the modified Descartes' theorem to the center points to determine the center is point of the new circles (no figure depicted).

$$d(X_4 + Y_4 i) = a(X_1 + Y_1 i) + b(X_3 + Y_3 i) + c(X_3 + Y_3 i) \pm 2^2\sqrt{a(X_1 + Y_1 i)b(X_2 + Y_2 i) + b(X_2 + Y_2 i)c(X_3 + Y_3 i) + c(X_3 + Y_3 i)a(X_1 + Y_1 i)}$$

$$(X_4 + Y_4 i) = \frac{-1(0 + 0i) + 2(-150 + 0i) + 3(0 + 200i) \pm 2^2\sqrt{2(-150 + 0i)3(0 + 200i)}}{6}$$

$$(X_4 + Y_4 i) = \frac{(-300 + 600i) \pm 2^2\sqrt{-180000i}}{6} = (-50 + 100i) \pm (100 - 100i)$$

$$d = 150 + 0i \text{ and } -150 + 200i$$

Since a circle at the center point (150,0) already exists (C3) corresponding to the curvature of 2, the point for the circle of curvature 6 is at (−150,200).

Repeating this process for the all of combinations of 3 of the 5 circles from the previous iteration, gives the following six (6) new circles (no figures are depicted):

| Circle | Curvature (radius) | Center Point |
|---|---|---|
| C5 | 6 (50 mm) | (−150, 200) |
| C6 | 6 (50 mm) | (150, 200) |
| C7 | 6 (50 mm) | (150, −200) |
| C8 | 6 (50 mm) | (−150, −200) |
| C9 | 15 (20 mm) | (0, −80) |
| C10 | 15 (20 mm) | (0, 80) |

ADDITIONAL ITERATIONS

This process continues filling in the blank spaces within the structure for each successive iteration, with each successive iteration's curvatures getting progressively smaller. FIG. 3 depicts the results after iteration 4, which raises the total number of circles to 29 (no figures depicted). In fact, the normalized curvatures are fairly well known for this version of the gasket, which is symmetrical along the X and Y planes, as [−1,2,2], [3,3], [6,6,6,6,15,15], [11,11,11,11,14, 14,14,14,23,23,23,23,35,35,38,38,38,38] for the first 4 iterations and can be calculated further using the above formulas.

What is claimed is:

1. A resonator, comprising:

a primary conductor having a first end and a second end and being substantially annular shaped, disposed on a substrate;

a plurality of secondary conductors each having a first end and a second end and being substantially annular shaped, disposed on said substrate and bounded by said primary conductor;

a plurality of tertiary conductors each having a first end and a second end and being substantially annular in shape, disposed on said substrate and bounded by said primary conductor, wherein said tertiary conductors are determined in dimension according to an iterative computation of $$d = a + b + c \pm 2^2\sqrt{ab + bc + ca}$$

where a is the normalized curvature (i.e., 1/radius) of a first reference conductor;

b is the normalized curvature (i.e., 1/radius) of a second reference conductor;

c is the normalized curvature (i.e., 1/radius) of a third reference conductor;

and d is the normalized curvature of each of a tertiary conductor generated in a current iteration; and wherein said tertiary conductors are determined in location according to an iterative computation of:

$$d(X_4 + Y_4 i) = a(X_1 + Y_1 i) + b(X_3 + Y_3 i) + c(X_3 + Y_3 i) \pm 2^2\sqrt{a(X_1 + Y_1 i)b(X_2 + Y_2 i) + b(X_2 + Y_2 i)c(X_3 + Y_3 i) + c(X_3 + Y_3 i)a(X_1 + Y_1 i)}$$

where $X_1+Y_1i$ is the center point coordinate of said first reference conductor;

$X_2+Y_2i$ is the center point coordinate of said second reference conductor;

$X_3+Y_3i$ is the center point coordinate of said third reference conductor; and $X_4+Y_4i$ are the center point coordinates of each of a tertiary conductor generated in a current iteration;

and where each of said primary conductor, said secondary conductors and said tertiary conductors comprise a predetermined distance gap between said first end and said second end.

2. The resonator of claim 1, choosing said first, said second, and said third reference conductors from a like number of preexisting conductors.

3. The resonator of claim 1 where said primary, said secondary, and said tertiary conductors have a predetermined width.

4. A method for designing a substantially planar resonator, comprising the steps of:

selecting a predetermined radius and cross-sectional width of a annularly shaped outer conductor;

selecting a predetermined radius, cross-sectional width, and location of a first pair of annularly shaped inner conductors such that they are bounded by said annularly shaped outer conductor and substantially tangent to each other and to said annularly shaped outer conductor; and iteratively generating, according to a predetermined function, successive annularly shaped inner conductors, each being bounded by said annularly shaped outer conductor and each being substantially tangent to at least two preexisting annularly shaped conductors.

5. The method of claim 4, where said predetermined function comprises:

$$d = a + b + c \pm 2^2\sqrt{ab + bc + ca}$$

where a is the normalized curvature (i.e., 1/radius) of a first reference conductor;

b is the normalized curvature (i.e., 1/radius) of a second reference conductor;

c is the normalized curvature (i.e., 1/radius) of a third reference conductor; and d is the normalized curvature of each of said successive annularly shaped inner conductor generated in a current iteration; and wherein the location of each said successive annularly shaped inner conductor is determined according to an iterative computation of:

$$d(X_4 + Y_4 i) = a(X_1 + Y_1 i) + b(X_3 + Y_3 i) + c(X_3 + Y_3 i) \pm 2^2\sqrt{a(X_1 + Y_1 i)b(X_2 + Y_2 i) + b(X_2 + Y_2 i)c(X_3 + Y_3 i) + c(X_3 + Y_3 i)a(X_1 + Y_1 i)}$$

where $X_1+Y_1i$ is the center point coordinate of said first reference conductor;

$X_2+Y_2i$ is the center point coordinate of said second reference conductor;

$X_3+Y_3i$ is the center point coordinate of said third reference conductor; and $X_4+Y_4i$ are the center point coordinates of each of said successive annularly shaped inner conductors generated in a current iteration.

6. An electrical resonating device comprising:

an outermost annularly shaped conductor having a non-conducting gap at a point along its circumference;

a plurality of successive pairs of annularly shaped conductors each having a non-conducting gap at a point along their circumference;

said plurality of successive pairs being disposed interior to said circumference of said outermost annularly shaped conductor;

said annularly shaped conductors disposed on a substantially planar substrate;

said annularly shaped conductors are substantially annularly shaped; and where said plurality of successive pairs of annularly shaped conductors have a maximum diameter determined by a residual space interior to said outermost annularly shaped conductor into which said successive pairs of annularly shaped conductors are placed.

7. The electrical resonating device of claim 6 where said non-conducting gap dimension and orientation along said circumference is predetermined.

8. The electrical resonating device of claim 6 having biasing elements interconnected across said non-conducting gap.

* * * * *